US005735007A

United States Patent [19]

Choi

[11] Patent Number: 5,735,007

[45] Date of Patent: Apr. 7, 1998

[54] POWER SUPPLY SYSTEM OF A WASHING MACHINE WITH AN AUTOMATIC DOOR OPENING/CLOSING APPARATUS

[75] Inventor: Ssi Chol Choi, Suwon, Rep. of Korea

[73] Assignee: Samsung Electronics Co., Ltd., Suwon, Rep. of Korea

[21] Appl. No.: 740,071

[22] Filed: Oct. 24, 1996

[30] Foreign Application Priority Data

Nov. 9, 1995 [KR] Rep. of Korea ..... 1995-40476

[51] Int. Cl.[6] ..... D06F 33/02

[52] U.S. Cl. ..... 8/159; 68/12.16; 68/12.26; 68/12.27; 68/196

[58] Field of Search ..... 8/159; 68/12.26, 68/12.27, 23 R, 196, 12.16; 49/31

[56] References Cited

U.S. PATENT DOCUMENTS

| | | | |
|---|---|---|---|
| 4,510,777 | 4/1985 | Ellingson et al. | 68/12.26 |
| 4,623,179 | 11/1986 | Davis et al. | 68/12.26 X |
| 4,866,955 | 9/1989 | Blair et al. | 68/12.26 X |
| 5,038,587 | 8/1991 | Harmelink | 68/12.26 |
| 5,070,565 | 12/1991 | Sood et al. | 68/12.16 X |
| 5,546,773 | 8/1996 | Lee | 68/196 |

*Primary Examiner*—Philip H. Coe

*Attorney, Agent, or Firm*—Burns, Doane, Swecker & Mathis, L.L.P.

[57] ABSTRACT

There is disclosed a power supply system for a washing machine which has an automatic door opening/closing apparatus designed for automatically opening or closing a door, a washing machine driving unit for enabling the washing machine to perform the washing operation, and a control component for controlling the operation of the washing machine driving unit. The power supply system includes a step-down transformer which has a primary winding directly connected to a power source and secondary windings formed of a first and a second secondary windings so as to decrease an alternating-current (AC) voltage at a predetermined ratio; a first power supply unit connected to the first secondary winding of the step-down transformer, and converting a first decreased AC voltage into a first direct-current (DC) voltage that is supplied to the control unit; a second power supply unit connected to the second secondary winding of the step-down transformer, and converting a second decreased AC voltage into a second DC voltage that is supplied to a door/lamp driver; the door/lamp driver having an input terminal connected to the second power supply unit and output terminals respectively connected to a door motor and a lamp, which allows them to be activated; and a power switch connected between the power cord and the washing machine driving unit.

8 Claims, 4 Drawing Sheets

POWER SUPPLY SYSTEM OF A WASHING MACHINE WITH AN AUTOMATIC DOOR OPENING/CLOSING APPARATUS

BACKGROUND OF THE INVENTION (1) Field of the Invention

The present invention relates generally to a power supply system for a washing machine having an automatic door opening/closing apparatus. More particularly, it relates to a power supply system in a washing machine which washing machine has an auxiliary DC power supply for operating a door motor and a lamp associated with the automatic door opening/closing apparatus so that the automatic door opening/closing apparatus can operate from the DC power supply, independent of the primary washing operation of the washing machine.

(2) Description of the Prior Art

A washing machine is a household electric appliance which uses water for washing, therefore a particular power supply system is employed that is designed to prevent leakage of electricity in the washing machine. Attention is first invited to FIG. 1 showing a block diagram depicting the construction of a conventional power supply system for a washing machine.

As shown in FIG. 1, a conventional power supply system of a washing machine is realized through a power cord 100 which is connected to a source of power whose voltage is either 110 V or 220 V for household use, a power switch 101 that has one end connected to the power cord 100, and is turned on or off in order to either supply power to the washing machine or to cut off power applied to the washing machine, and an alternating-current (AC) load 103 that has one output terminal connected to the power switch 101 which operates from AC power.

The conventional power supply system also includes a step-down transformer 102 which has a primary (input) winding connected to the power switch 101 and a secondary (output) winding whose alternating-current voltages are lower than those applied to the primary winding so as to deliver an output voltage lower than the input voltage. Also present is a control printed circuit board (PCB) 110 which contains integrated circuit chips and connections for electronic components which control the various actions of the washing machine.

The control PCB 110 includes a microprocessor 111 which controls the overall operation of the washing machine, a key input unit 114 which directly receives a desired key input from a user and provides it to the microprocessor 111, an operating state sensing unit 115 that monitors the various operating states of the washing machine and provides the results to the microprocessor 111, and an AC load driver 113 which allows the AC load 103 to go into action in response to the generation of a control signal from the microprocessor 111.

The control PCB 110 also includes: a display 116 which visually indicates various data such as the current operating state of the washing machine upon receipt of the control signal of the microprocessor 111; a buzzer 117 which audibly announces the operating state of the washing machine, such as an abnormal condition of a certain interior electronic component, by producing a buzzing sound upon receipt of the control signal of the microprocessor 111; and a power supply unit 112 which supplies direct-current (DC) voltage produced by rectifying and smoothing the AC voltage decreased in amplitude by the step-down transformer 102.

In the above-described construction, the AC load 103 include a washing motor, a water supply valve, a drain valve, and the like. The AC load driver 113 is formed of a triac and furnishes the AC load 103 with the AC power which is phase-controlled by the microprocessor 111.

In the meantime, unlike other household electric appliances such as televisions, video cassette recorders, and the like, the washing machine employs water for washing, and is controlled with key inputs from a user during laundering. Thus, there is no need to install an additional memory device nor a backup power supply used for refreshing the memory device in the washing machine.

According to a common-type washing machine, the power switch 101 is interposed between the step-down transformer 102 and AC load 103 and the source of the AC power. Thus, it is designed to cut off the power applied to the AC load 103 and the control PCB 110 as well when the power switch 101 is turned off. The AC load 103 puts high voltage electric currents to use, and the electronic components which are supplied with power by way of the step-down transformer 102 are the loads employing electric currents which are lower than those of the AC load 103. Once power is applied to the above two kinds of loads at the same time, it may give rise to the flow of overcurrent, which is the principal cause of the high leakage current problem.

The power switch 101 consists of an automatic opening switch such as a solenoid, which is designed to be turned off automatically at the time completion of all the washing processes.

In recent years, household electric appliances of large capacity are becoming extremely popular among consumers. In line with such a trend, washing machines are also designed to be of larger capacities, and doors used for those washing machines become bigger and heavier, too. Accordingly, it may be difficult for users to lift the lid of a washing machine by hand.

In order to eliminate the above-described disadvantage, a washing machine with an automatic door opening/closing apparatus has been proposed. This washing machine, however, should be equipped with a power supply system which is more improved so as to stably furnish the proper electric current and voltage to the automatic door opening/closing apparatus as well as to other electronic components of the washing machine for their continuous operation.

SUMMARY OF THE INVENTION

Accordingly, the present invention is directed to a power supply system adapted to a washing machine with an automatic door opening/closing apparatus.

It is an objective of the present invention to provide a power supply system for a washing machine with an automatic door opening/closing apparatus which may independently supply power to an alternating-current (AC) load so as to prevent the flow of overcurrent into interior electronic components of the washing machine.

It is another objective of the present invention to provide a power supply system for a washing machine with an automatic door opening/closing apparatus in which at least one power supply unit is provided with respect to a direct-current load in order to alternatively control the system loads.

It is still another objective of the present invention to provide a power supply system for a washing machine with an automatic door opening/closing apparatus which includes an auxiliary direct current (DC) power supply for the automatic door opening/closing apparatus so that the automatic door opening/closing apparatus can operate from a DC power supply, independently of the primary washing operation of the washing machine.

Additional features and advantages of the present invention will be set forth in the description which follows, and in part will be apparent from the description, or may be learned by practice of the invention. The objectives and other advantages of the present invention will be realized and attained by the structure particularly pointed out in the written description and claims hereof as well as the appended drawings.

To accomplish these and other advantages, the present invention discloses a power supply system for a washing machine having an automatic door opening/closing apparatus designed for the automatic door opening/closing function with a washing machine driving unit enabling the washing machine to perform the washing operation, and a control unit for controlling the operation of the washing machine driving unit, and wherein the power supply system includes: at least one power supply unit applying power to a first load; a door/lamp driver enabling a door motor and a lamp to go into action for an automatic door opening/closing operation; and an on/off control unit for controlling a turned-on or turned-off state with respect to a second load only.

The power supply unit consists of a first power supply which generates power to be applied to the control unit, and a second power supply which produces power to be applied to the door/lamp driver.

The first load serves as a direct-current (DC) load which uses DC power, and the second load corresponds to an alternating-current (AC) load. A wash motor, a water supply valve, a drain valve, and the like, are included in the second load.

According to another aspect of the present invention, there is disclosed a power supply system for a washing machine having an automatic door opening/closing apparatus designed for an automatic door opening/closing function with a washing machine driving unit allowing the washing machine to perform the washing cycle, and a control unit for controlling the operation of the washing machine driving unit.

The inventive power supply system includes a step-down transformer which has a primary winding directly connected to a power cord and secondary windings formed of 1st and 2nd secondary windings so as to cut alternating-current (AC) voltage at a predetermined ratio; a first power supply unit which is connected to the 1st secondary winding of the step-down transformer, and converts the decreased AC voltages into direct-current (DC) voltages to supply them to the control unit; and a second power supply unit which is connected to the 2nd secondary winding of the step-down transformer, and converts the decreased AC voltage into DC voltage to supply them to a door/lamp driver.

This power supply system also includes the door/lamp driver having an input terminal connected to the second power supply unit and output terminals respectively connected to a door motor and a lamp, which allows them to go into action; and a power switch connected between the power cord and the washing machine driving unit.

Thus, while the power cord is making connections to a source of power, a door of the washing machine can be opened and closed automatically, irrespective of a turned-on or turned-off state of the power switch.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings wherein.

Figure 3C:
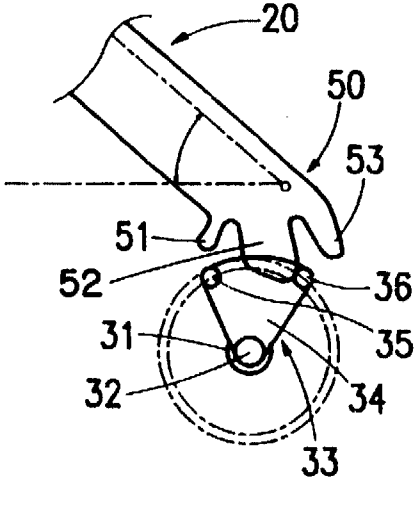
Figure 3B:
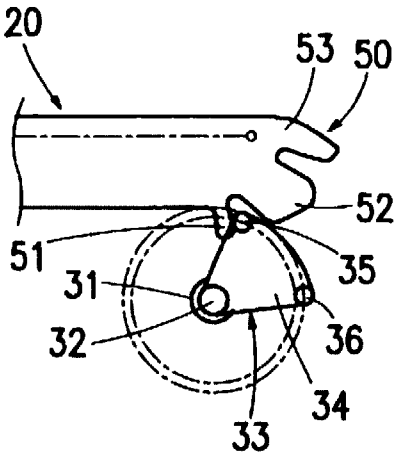
Figure 3A:
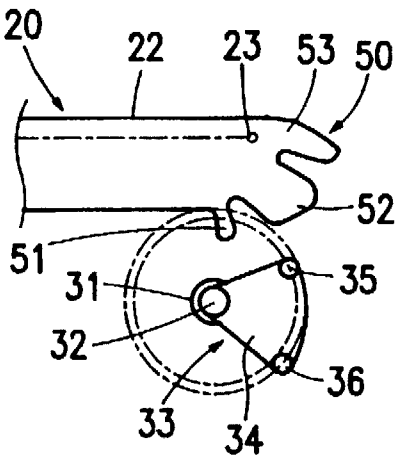
Figure 3E:
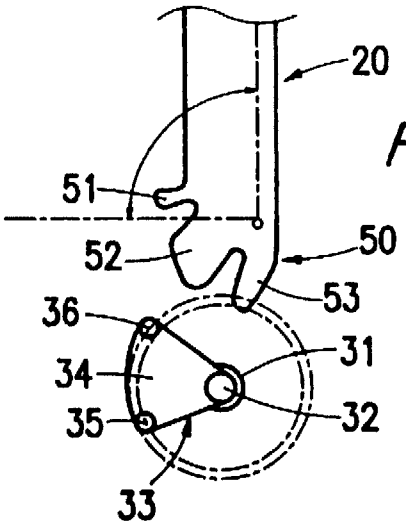
Figure 3D:
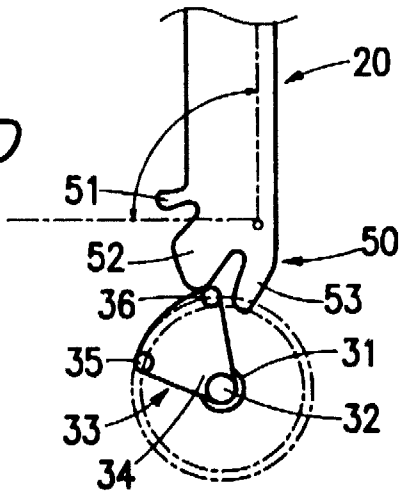
Figure 4:
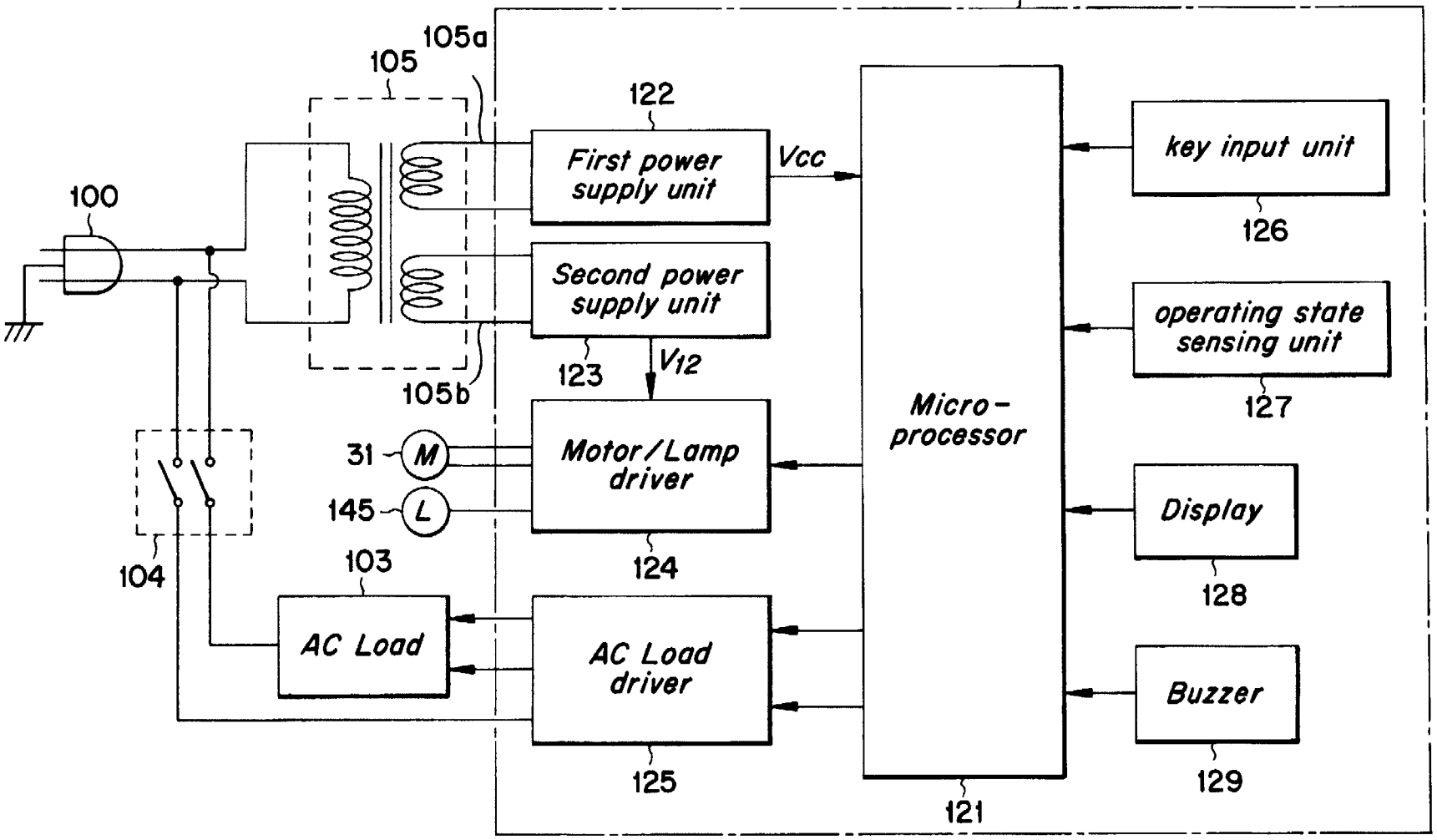

FIGS. 3A, 3B, 3C, 3D, and 3E respectively show enlarged views for describing the automatic door opening/closing action of the washing machine in sequential order in accordance with the present invention; and FIG. 4 is a block diagram for describing the power supply system of a washing machine in accordance with the present invention.

DETAILED DESCRIPTION OF THE PREFERRED EMBODIMENT

Reference will now be made in detail to the preferred embodiments of the present invention, examples of which are illustrated in the accompanying drawings.

Figure 1:
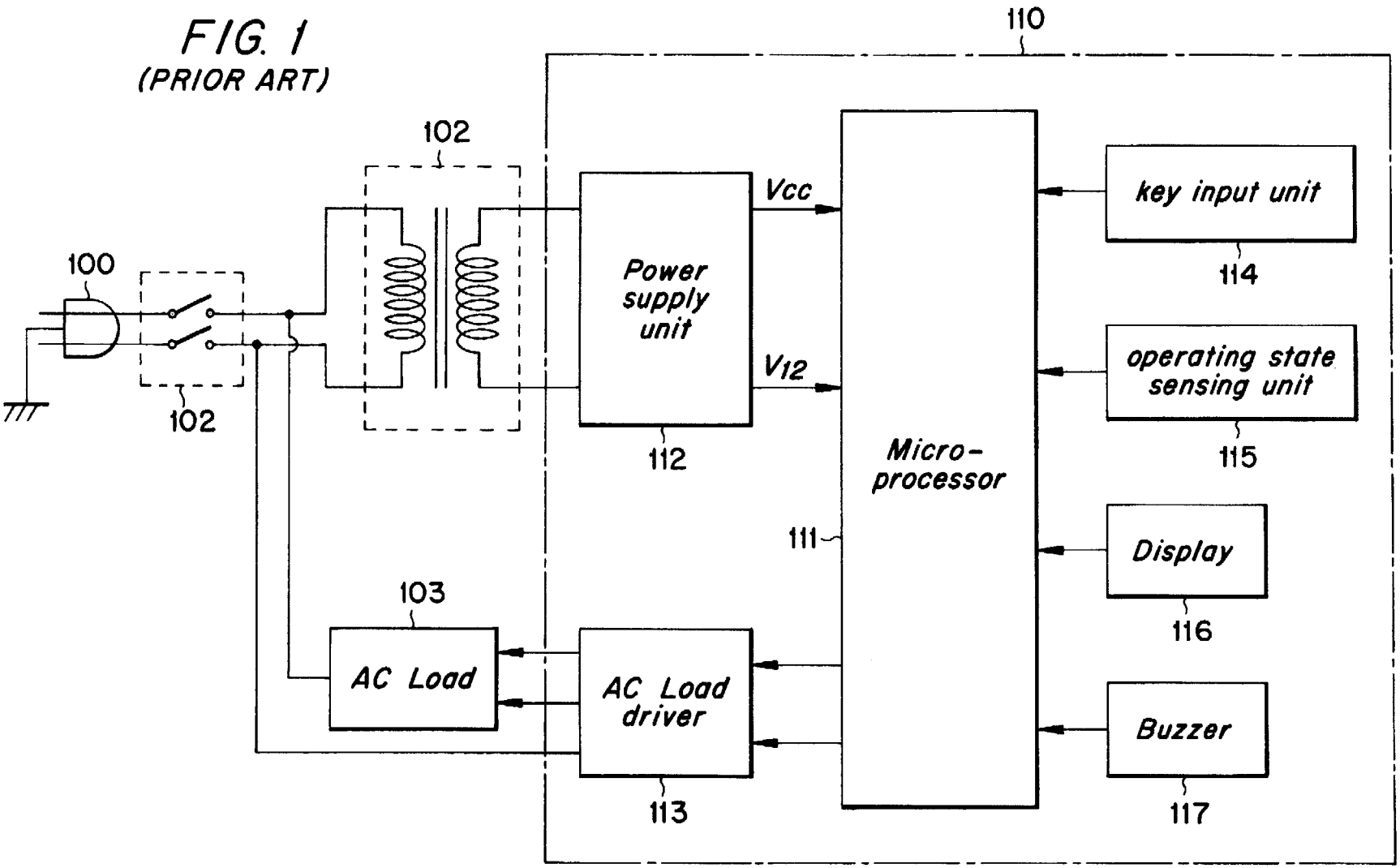
FIG. 1 (PRIOR ART)
FIG. 1 is a block diagram for describing the construction of a conventional power supply system of a washing machine.
Figure 2:
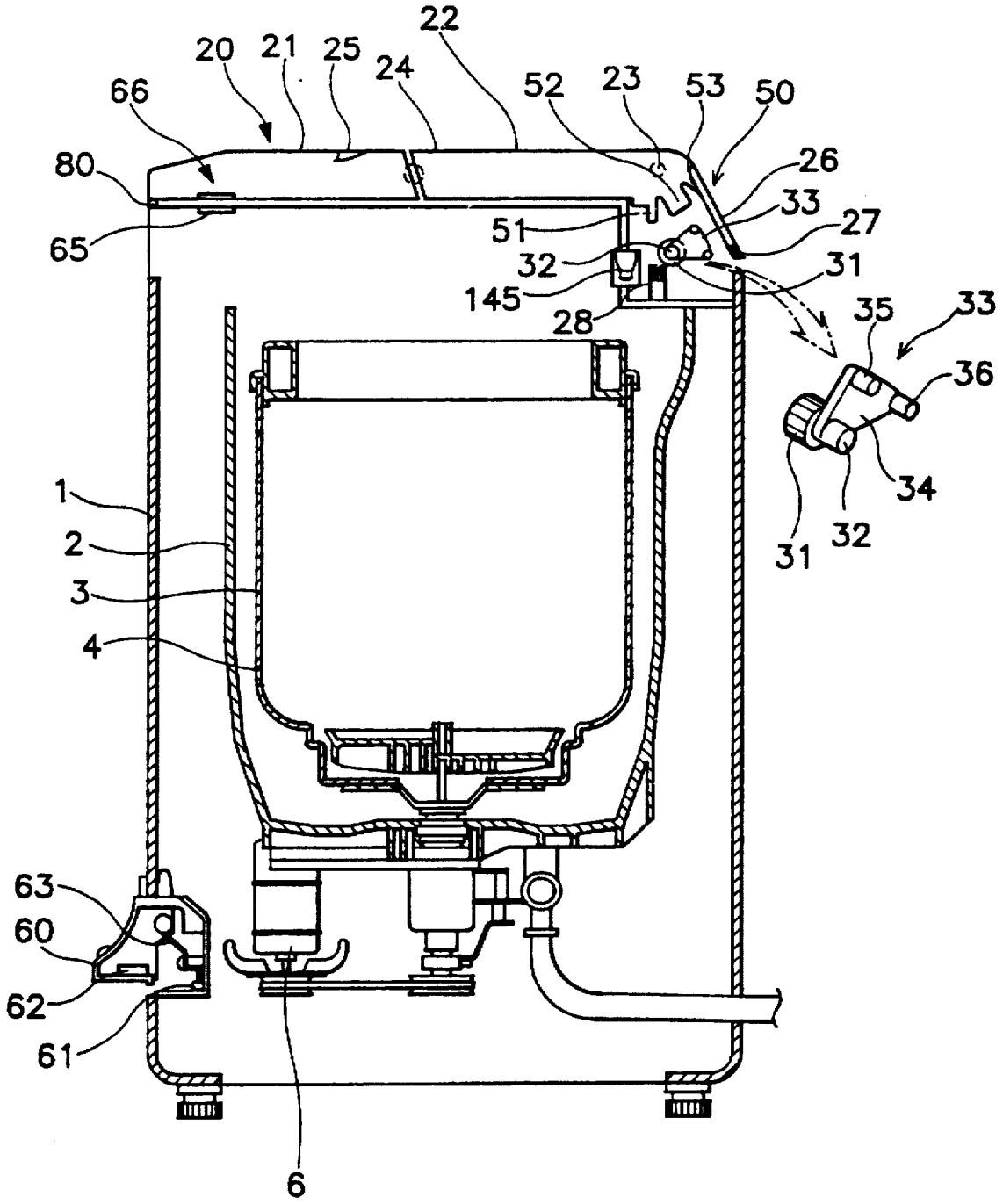
FIG. 2 is a sectional view of a washing machine with the automatic door opening/closing apparatus in accordance with the present invention.

FIG. 2 is a sectional view of a washing machine having an automatic door opening/closing apparatus in accordance with the present invention.

As shown in FIG. 2, the washing machine having the automatic door opening/closing apparatus includes a cylindrical-shaped water tub 2 which is placed inside of a main body 1, a laundry tub 3 which is rotatably mounted in the water tub 2, which laundry tub 3 has a plurality of holes 4 so as to admit water from the water tub 2, and a door 20 that is disposed on the top of the main body 1 to open and close the entrance to the water and laundry tubs 2 and 3.

The door 20 consists of a front half member 21 which covers the front of the top of the main body 1, and a rear half member 22 which covers the rear of the top of the main body 1. The door 20 is formed to rotate about a first hinge 23 fixedly formed at the rear end of the main body 1, and the rear end of the front half member 21 is joined to the front end of the rear half member 22 by the use of a second hinge 24.

Accordingly, as the door 20 is opened, the front half member 21 can be folded close to the back of the rear half member 22. In other words, the front half member 21 is connected to the rear half member 22 to freely pivot with respect to the rear half member 22, and a rear portion of the rear half member 22 is joined to the main body 1 so as to swing therearound.

Near the first hinge 23 at the rear end of the main body 1, there is a driving/rotating means 30. The driving/rotating means 30 includes a door motor 31 which supplies force to the door 20 for its opening/closing function, and a rotary member 33 coupled to a rotating shaft 32 of the door motor 31. The rotary member 33 consists of a rotary plate 34 which is formed in fan shape, and first and second bosses 35 and 36 that circumferentially protrude from a front of the rotary plate On the rear section of the rear half member 22 of the door 20, there is a cam member 50 which is proximate to the first hinge 23. The cam member 50 includes first, second and third teeth 51, 52 and 53. As the rotary member 33 turns with rotation or reverse rotation of the door motor 31 (the movement for opening the door is defined as a forward rotation), the first and second bosses 35 and 36 engage teeth 51 to 53 thereby imparting a rotating force.

On a predetermined spot of the rear section of the main body 1, there is an open sensor which monitors the opening of the door 20. The open sensor is preferably a reed switch 28 that is fixedly mounted, and is sealed in a member (not illustrated) whose material is impervious to water. A permanent magnet 27 is fixed on a lever 26 extending from a rear portion of the rear half member 22. When the door 20 opens completely, the reed switch 28 contacts are closed by magnetic force from the permanent magnet 27.

On a predetermined spot of the front section of the main body 1, there is a closed sensor which monitors the closing of the door 20. The closed sensor is preferably a reed switch 65 that is fixedly mounted, and is sealed in a member (not illustrated) whose material is impervious to water. A permanent magnet 66 is fixed on a position opposite to the reed switch 65. When the door 20 closes completely, the reed switch 65 contacts are closed by magnetic force from the permanent magnet 66.

At a predetermined location on the front-lower section of the main body 1, there is a foot switch which generates a command to open or close the door 20. The foot switch preferably includes a reed switch 61 that is fixedly mounted, and is sealed in a member (not illustrated) whose material is impervious to water. Contacts of the reed switch 61 are controlled by magnetic force of a permanent magnet 62 attached to a pedal 60 which pedal 60 is supported by a leaf spring 63. In other words, as a user pushes the pedal 60 with his foot, the permanent magnet 62 approaches the reed switch 61 thereby closing the contacts of the reed switch 61.

Reference numerals denote the following elements: 25 is a handle used to open or close the door 20 manually; 80 is a roller used to smooth out the opening/closing operation of the door 20; and 6 is a wash motor.

Various modifications and variations can be made in the location and structure of the open sensor 28, the closed sensor 65 and the reed switch 61, without limitation to the above-described embodiment. For instance, the reed switch 61 may be disposed at a location on the upper section of the washing machine to be operated by hand. In this case, the reed switch 61 can be placed on a control panel (not illustrated) that is formed on the front top portion of the main body 1 along with other control keys.

According to the preferred embodiment of the present invention, the open sensor 28, the closed sensor 65, and the reed switch 61 are embodied by water-proof reed switches, in consideration of the characteristics of the washing machine in which it performs the washing operation with water, and common-type switches whose contacts are designed to function by mechanical contact may be substituted for the preferred switches.

FIGS. 3A, 3B, 3C, 3D, and 3E respectively show enlarged views for describing the automatic door opening/closing operation of the washing machine in sequential order in accordance with the present invention.

As shown in FIG. 3A, when the door 20 is closed completely, the first and second bosses 35 and 36 are separated from a radius of gyration of the first, second and third teeth 51, 52 and 53 so that the door 20 can be opened or closed manually. At this point, if there is an input for an automatic door opening, as a user pushes the pedal 60 with the foot, the rotary plate 34 rotates forward (counterclockwise). Accordingly, the first boss 35 comes to engage with the first tooth 51 after a predetermined period of time, as depicted in FIG. 3B. Under this condition, if the door motor 31 continues to rotate forward, the rear half member 22 is raised, and the second boss 36 engages with the second tooth 52 and rotates as is clearly depicted in FIGS. 3C and 3D.

When the second tooth 52 turns to open the door 20 completely, the second boss 36 disengages the second tooth 52. At this time, the door motor 31 stops operation, and as shown in FIG. 3E, the rotary plate 34 continues to turn for a predetermined period of time by inertial force of the door motor 31.

In conclusion, when the door 20 of the washing machine has been opened completely, the user is also able to manually close the door 20.

In order to close the door 20 automatically, the automatic door opening/closing apparatus of the present invention undergoes the process in a reverse order of the above-described process.

More specifically, if a user pushes the pedal 60 with his foot, the door motor 31 is driven to thereby drive the rotary plate 34 in reverse. Accordingly, the second boss 36 comes to engage with the third tooth 53 after a predetermined period of time goes by, as shown in FIG. 3D. Under the circumstances, the door motor 31 continues to reverse to let the rear half member 22 of the door 20 down gradually, and the first boss 35 comes to rotate while engaging with the second tooth 52, as shown in FIGS. 3B and 3C.

When the second tooth 52 goes on turning to close the door 20 completely, the first boss 35 diengages the second tooth 52. About this time, the door motor 31 stops operation, and the rotary plate 34 continues to rotate for a predetermined period of time by inertial force of the door motor 31, as shown in FIG. 3A.

In conclusion, all the electronic components return to the state of FIG. 3A.

FIG. 4 is a block diagram for describing the construction and operation of the power supply system of a washing machine in accordance with the present invention.

As shown in FIG. 4, an inventive power supply system of a washing machine with the automatic door opening/closing apparatus is realized through a power cord 100 which is connected to a source of power whose voltage may be 110 V or 220 V for household use; a power switch 104 that has one end connected to the power cord 100, and is turned on or off in order to either supply power to the washing machine or cut off power supplied to the washing machine; and an alternating-current (AC) load 103 that has a terminal connected to the power switch 104 and operates from AC power.

The power supply system also includes a step-down transformer 105 which has a primary (input) winding directly connected to the power switch 104 and secondary (output) windings that are formed of 1st and 2nd secondary windings whose AC voltages are lower than those applied to the primary winding so as to supply direct currents employed to control the internal electronic components of the washing machine and to display its operating state; and a control printed circuit board (PCB) 120 which includes integrated circuit chips and connections for electronic components that control the various actions of the washing machine.

The control PCB 120 includes a microprocessor 121 which controls the overall operation of the washing machine; a key input unit 126 which directly receives a desired key input from a user and provides the input to the microprocessor 121; an operating state sensing unit 127 that monitors the various operating modes of the washing machine and provides the results to the microprocessor 121; and an AC load driver 125 which controls the AC load 103 to be activated in response to command of the control signal from the microprocessor 121.

The control PCB 120 also includes a display 128 which visually indicates the various data such as the current operating mode of the washing machine in response to receipt of a control signal from the microprocessor 121; a buzzer 129 which audibly announces the information on operating state of the washing machine, such as an abnormal condition of a certain interior component by producing a buzzing pursuant to receipt of a control signal from the microprocessor 121; and a door/lamp driver 124 which has an input terminal connected to the second power supply unit and output terminals respectively connected to a door motor M and a lamp L, and controls their activation pursuant to receipt of a control command from the microprocessor 121.

The control PCB 120 further includes a first power supply unit 122 which is connected to the 1st secondary winding 105*a* of the step-down transformer 105, and converts the decreased AC voltage into DC voltage so as to supply the DC voltage to the control PCB 120; and a second power supply unit 123 which is connected to the 2nd secondary winding 105*b* of the step-down transformer 105, and converts the decreased AC voltage into DC voltage, so as to supply the DC voltage to the door/lamp driver 124.

In the above-described construction, the AC load 103 includes a wash motor, a water supply valve, a drain valve, and the like. The AC load driver 125 includes a triac that furnishes the AC load 103 with AC power which is phase-controlled by the microprocessor 121.

The key input unit 126 is connected to the above-mentioned reed switch 61 (open/close switch), includes function keys. The operating state sensing unit 127 receives input from the open sensor 28 and the close sensor 65 mentioned above.

The step-down transformer 105 includes the two secondary windings 105*a* and 105*b*, which construction prevents instability of power applied to the electronic components such as when the door motor 31 is activated in order to open or close the door 20 automatically.

The primary winding of the step-down transformer 105 is directly connected to the power cord 100.

When the power cord 100 is connected to a source of power, the proper DC power is furnished to the microprocessor 121 to the motor/lamp driver 124 through the first and second power supply units 122 and 123.

Under this condition, if a user pushes the pedal 60 to open or close the door 20, the microprocessor 121 receives such a command for opening or closing the door 20, and determines the current state of the door 20 with reference to the data supplied by the open sensor 28 and the closed sensor 65. The microprocessor 121 makes the door motor 31 turn in a forward direction according to that data, and permits the state of the door 20 to be changed to the contrary.

When the power switch 104 is not turned on, the AC load 103 and the AC load driver 125 are not connected to the AC power, and even if the microprocessor 121 is in operation, the washing process cannot be carried out by the operation of the AC load 103. According to the inventive washing machine having the automatic door opening/closing apparatus, when the power cord is connected to a source of power, the door can be opened and closed automatically, irrespective of the open or closed state of the power switch 104 by which the washing machine can implement the washing process. Thus, the present invention permits the washing machine to maintain normal operation without breakdown and malfunction due to the high leakage current problem and offers greater convenience to users.

It will be apparent to those skilled in the art that various modifications and variations can be made in a washing machine with the inventive apparatus for automatically opening and closing a door of the washing machine without departing from the spirit or scope of the invention. Thus, it is intended that the present invention cover the modifications and variations of this invention provided they come within the scope of the appended claims and their equivalents.

What is claimed is:

1. A power supply system for a washing machine having an automatic door opening/closing apparatus designed for automatic door opening/closing action, and for a washing machine driving means which drives the washing machine to perform a washing operation, and for a control means for controlling operation of the washing machine driving means, said power supply system comprising:

a step-down transformer which has a primary winding connected to receive line power through a power cord and secondary windings formed of a first secondary winding and a second secondary winding to decrease alternating-current (AC) voltage at a predetermined ratio before being supplied to internal components of the washing machine;

first power supply means connected to the first secondary winding of the step-down transformer for converting a first decreased AC voltage into a first direct-current (DC) voltage, and for supplying the first DC voltage to the control means;

second power supply means connected to the second secondary winding of the step-down transformer for converting a second decreased AC voltage into a second DC voltage, and supplying the second DC voltage to a door/lamp driving means;

said door/lamp driving means having an input terminal connected to said second power supply means and output terminals connected to a door motor and to a lamp, thereby allowing said door motor and said lamp to be activated; and power switching means connected between the line power and the washing machine driving means.

2. A power supply system for a washing machine as set forth in claim 1, further comprising:

a lamp for illuminating a laundry tub of the washing machine, the lamp being powered by said second power supply means.

3. A power supply system for a washing machine as set forth in claim 1, wherein while said power cord is connected to said line power, the door of the washing machine can be opened and closed automatically, said automatic opening and closing being independent of a state of said power switching means.

4. A power supply system for a washing machine as set forth in claim 1, wherein said washing machine driving means is an AC load, and includes a washer motor, a water supply valve and a drain valve.

5. A power supply system for a washing machine that has an automatic door, said washing machine including an AC load, an AC load driver, a door driving means for opening and closing said automatic door, and a controller for controlling the door driving means and the AC load driver, the power supply system comprising:

a transformer having a primary winding, a first secondary winding and a second secondary winding, said primary winding receiving power from a commercial power supply, said first secondary winding generating a first voltage and said second secondary winding generating a second voltage;

a first power supply unit for receiving said first voltage and converting said first voltage to a first DC voltage that is supplied to said controller;

a second power supply unit for receiving said second voltage and converting said second voltage to a second DC voltage that is supplied to said door driving unit; and a switch connected between said commercial power supply and said AC load.

6. The power supply claimed in claim 5, wherein the second power supply unit is connected to a lamp for illuminating the interior of the washing machine.

7. The power supply claimed in claim 5, wherein the AC load is selected from the group consisting of a washer motor, a water supply valve and a water drain valve.

8. A method of supplying in a washing machine that includes an automatic door, an AC load, an AC load driver, a door driving means for opening and closing said door, and a controller for controlling the door driving means and the AC load driver, the method comprising the steps of:

transforming a commercial AC voltage into a first voltage and a second voltage using a transformer having a single primary winding, a first secondary winding, and a second secondary winding, said first voltage and a second voltage being generated by said first and second secondary windings, respectively;

converting said first voltage to a first DC voltage that is supplied to said controller; and converting said second voltage to a second DC voltage that is supplied to said door driving unit.

* * * * *